United States Patent [19]

Adam

[11] Patent Number: 4,717,167

[45] Date of Patent: Jan. 5, 1988

[54] CROSS-COUNTRY SKI

[75] Inventor: Guenter Adam, Straubling, Fed. Rep. of Germany

[73] Assignee: PUMA AG Rudolf Dassler Sport

[21] Appl. No.: 830,876

[22] Filed: Feb. 19, 1986

[30] Foreign Application Priority Data

Feb. 19, 1985 [DE] Fed. Rep. of Germany ..... 3505666

[51] Int. Cl.[4] ..... A63C 5/00

[52] U.S. Cl. ..... 280/604

[58] Field of Search ..... 280/601, 604, 605, 607, 280/609

[56] References Cited

U.S. PATENT DOCUMENTS 4,109,931 8/1978 Woitschatzke ..... 280/605

FOREIGN PATENT DOCUMENTS 2555461 8/1976 Fed. Rep. of Germany .
2732091 7/1977 Fed. Rep. of Germany .
3002969 1/1980 Fed. Rep. of Germany .
3040253 10/1980 Fed. Rep. of Germany .
3142623 10/1981 Fed. Rep. of Germany .
3134051 3/1983 Fed. Rep. of Germany .
3334488 3/1984 Fed. Rep. of Germany ..... 280/604
3415641 4/1984 Fed. Rep. of Germany .

*Primary Examiner*—John J. Love
*Assistant Examiner*—Richard Camby
*Attorney, Agent, or Firm*—Sixbey, Friedman & Leedom

[57] ABSTRACT

According to the present invention, in a cross-country ski with a movable center section that is accomodated in a cut-out portion in the center of the ski and which can be moved out from the running surface or sole of the ski and retracted back into the running surface or sole of the ski, and which has on its running surface or sole an aggressive non-skid profile and/or covering that reacts with the surface of the snow, the moving center section (5) is configured as a spring part and is joined to the remaining portion of the body of the ski (1) at both its ends. The ski binding (10) for the toe of the shoe (40) is secured to the moving section (5) and is thus arranged higher relative to the surface (11) of the adjacent side portions (6,7) of the remaining body of the ski (1) when the center section (5) is not working against the surface of the snow. The moving section (5) is brought immediately into the working position when the skier shifts his/her weight from the heel and the ball of the foot (glide position) exclusively onto the ball of the foot (push-off position).

35 Claims, 9 Drawing Figures

Figures 1, 2, 3:
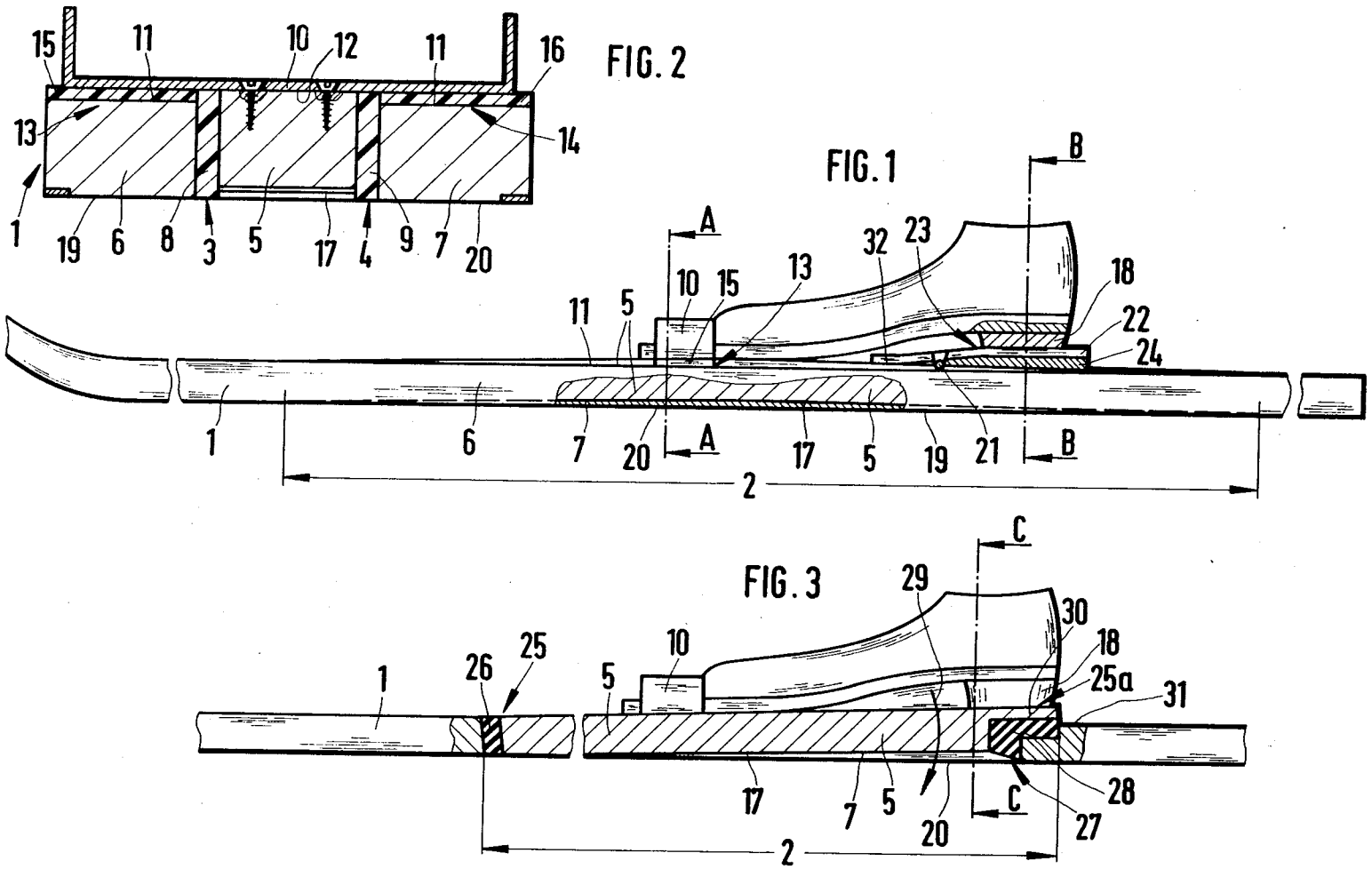

A
B
C
1
2
3
4
5
6
7
8
9
10
11
12
13
14
15
16
17
18
19
20
21
22
23
24
25
25a
26
27
28
29
30
31
32

CROSS-COUNTRY SKI

The present invention relates to a cross-country ski of the type having a movable centre section installed in a cut-out area of a centre part of the ski so as to be outwardly movable from the running surface of the ski and retractable therein, the movable centre section being provided with a non-skid surface and/or a coating that will react with a surface of snow.

A cross-country ski of this kind is described in DE-OS No. 27 32 091. In this, in the centre part of the ski, in front of the toe of the shoe, there is a longitudinal chamber in the ski. Within this there is a fitted longitudinal bar or rail, that is perpendicular to the direction of movement, this bar being supported so as to be displaceable. With springs installed between the longitudinal rail and the base of the chamber located above them, the longitudinal rail is pressed downwards. The underside of the longitudinal rail is arched outwards and because of the pressure exerted by the springs presses against an intermediate layer that seals the longitudinal chamber and can be elastically deflected. A lever that extends forwards is fitted to the ski binding that is attached to the smooth upper surface of the ski, and when the shoe is completely planted on the ski, i.e., in the pure gliding plane, this draws the rail upwards and thus disengages the intermediate layer from the surface of the snow. Depending on the heel movement of the skier, the rail is forced downwards and the frictional outer surface of the intermediate layer is moved beyond the running surface of the ski and thus into engagement with the surface of the snow. When this happens, the relatively narrow surface of the springs in the base portion of the longitudinal chamber generates considerable forces, so that this part has to be particularly stable and also stiffened. In addition, a mechanism that is simple, but also vulnerable under winter conditions, is required. If the lever ices up there is a danger that the mechanism can become inoperative. However, good traction becomes particularly important under such winter conditions.

In another cross-country ski according to DE-OS No. 30 02 969 there is in the centre part of the ski a slot that is continuous from top to bottom, this slot being of a width that is approximately that of half the width of the ski. Within this, oriented in the longitudinal direction, there is a longitudinal rail, this being supported by means of hinged tabs so as to be movable, perpendicular to the direction of movement. A lever is secured to this rail, and this lever is supported so as to be able to pivot about a pin that is supported in the centre part of the ski in the ski walls that remain on either side of the slot. The tip portion of the ski binding also engages on the lever. Thus, when the sole of the shoe is planted in position, the longitudinal rail is raised by the lever, and when the sole of the shoe is inclined, which is to say when the shoe is also pivotted, the non-slip underside of the rail is pressed against the snow. Here, too, there is a mechanism that does not function if iced up, and which is relatively vulnerable to damage. In addition, a shoe with a rigid sole, of the type used for downhill skiing, is essential. The ski cannot be used so that this device functions as it should in the climbing mode if the skier is wearing the lighter shoes customarily worn for cross-country skiing, which have a sole that can be bent, at least in the area of the ball of the foot.

Further, it is known from DE-OS No. 31 34 051 that the ski can be configured from two halves, separated transversely at the middle, and joined beneath the area of the ball of the foot by means of a flexible element, with straight supporting elements to manage the gliding phase being provided in the recessed side edges. When the shoe is lifted the halves of the ski are pressed downwards through a crank system, so that the non-skid running surface is pressed against the surface of the snow. When the shoe is planted firmly the two halves of the ski are raised at the centre and the supporting elements are thereby brought into the gliding phase. Quite apart from the fact that the stability of the ski is greatly impaired by the transverse separation, a ski of this type also necessitates a sensitive mechanism. Furthermore, the application pressure of the non-skid running surface or sole is dependent not only on the body weight of the skier, but also on the inclination of the shoe. At the beginning of the push-off phase, when the pressure load is at its greatest, the shoe is not sufficiently inclined so that the non-skid surface is not fully effective in this most important phase.

It is important to point out that all conventional cross-country skis that are currently on the market are so constructed that the best possible compromise between gliding and climbing is achieved. As a solution in principle for achieving this compromise, the body of the ski has a particularly stiff "bridge" at its centre, this coming into the least possible contact with the snow base during the gliding phase but which also offers the compromise that it can take climbing aids (climbing wax, skins, and the like). In addition, there is no way of preventing these aids from coming into contact with the snow during the gliding phase and thus generating an unwanted braking effect. On the other hand, the compromise is in the fact that this stiff bridge area can only be brought into the desired total-contact with the snow base during the push-off phase with more or less difficulty, depending on the degree of stiffness that is built into it, so as to optimize the desired push-off effect.

It is intended that the disadvantages of known cross-country skis be avoided with the present invention. The cross-country ski according to the present invention is to be so improved as to ensure a good transfer of force between the ski and the surface of the snow, primarily and preferably in the first push-off phase, this being achieved by simple means, and also without the danger that the moving centre section be rendered inoperative, for example, by icing up. Above all, the cross-country ski must display very good gliding characteristics in the gliding phase, and these should not be nullified, even partially, by countermeasures such as climbing aids.

This task has been solved by the present invention via the combination of features set out in the more detailed description thereof, below.

The present invention provides that for all practical purposes all the mechanical components and/or recesses that cannot work if iced up are avoided, and it is ensured that the total push-off force—particularly in the first phase of the push-off—are transferred completely to the surface of the snow.

Above all else, the actual body of the cross-country ski according to the present invention can be configured as a straightforward downhill or sliding ski (such as an alpine-type downhill ski), since the moving centre section is completely separated from the snow during the glide phase. This means that this centre section can be provided with an extremely aggressive non-skid surface and, furthermore, can be brought into immediate contact with the snow during the push-off phase, this being possible without the expenditure of any great effort. Both the actual sliding-type ski and the movable centre section can thus be optimized for the corresponding task. The centre section does not interfere with the glide phase and presents a large area to the snow immediately during the push-off phase.

It is important that no additional aids such as linkages, which can become inoperable in unfavourable weather conditions, are required to move the centre section, but that it is sufficient that, on a first simple shift of weight from the heel to the ball of the foot (push-off phase) on the part of the skier the centre section is brought immediately into the working position. By this means, it is ensured that the body weight or the push-off force can be made fully effective without any detracting factors such as frictional forces or blocking caused by icing up coming into play.

It is known from DE-OS No. 25 55 461 that a ski can be divided by a longitudinal slot and on part can be provided with a non-skid running surface and then can be pressed against the snow through the tip of the shoe during the push-off phase through a distance piece, with the other, sliding portion being pressed against the snow with the heel, through another distance piece. The distance pieces are covered over with clamps. However, snow and ice can pack up in these so that eventually it is only the non-skid or only the sliding surface that is pushed against the snow. In addition, with this two-part version there is an increased risk of falling. These disadvantages are not encountered with the present invention.

Figures 4, 5, 6, 7, 8, 9:
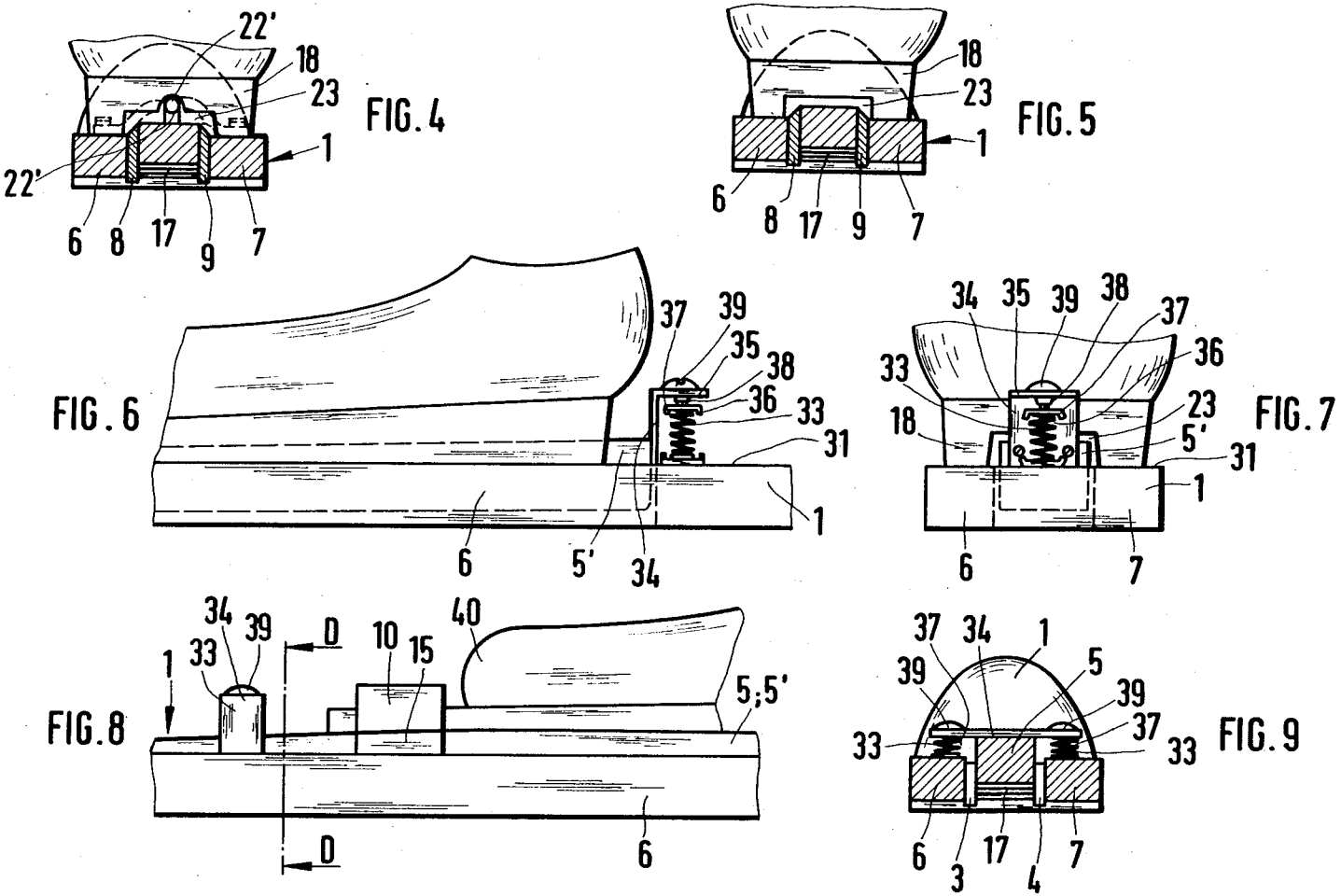

Further advantageous developments of the present invention are set out and are described in greater detal below on the basis of the drawings appended hereto. These drawings are as follows:

FIG. 1: a side view of the ski according to the present invention;

FIG. 2: the same ski in cross-section on the section line A—A in FIG. 1, but without the shoe;

FIG. 3: a side view of a ski having a pivotting centre section, this being in crosssection;

FIG. 4: a view on the section line B—B in FIG. 1;

FIG. 5: a view on the section line C—C in FIG. 3;

FIGS. 6,8: detailed views of the centre section of the ski with an adjustable spring, from the side;

FIG. 7: a view of a version as in FIG. 6, from the rear;

FIG. 9: a view on the section line D—D in FIG. 8.

In the drawings, a ski is numbered 1, and this has two longitudinal slots 3,4 in its middle area; these form a transverse centre section 5 from the longitudinal centre area 2, said section 5 being slightly curved upwards, at least on its running surface 17, and being flanked by two outer section 6,7. As seen in FIGS. 1 and 2, the centre section 5 is spring mounted relative to the remainder of the ski, since in this version it forms a structural unit with the body of the ski through its ends. The slots 3,4 can be filled with distance pieces 8,9 that are plugged, cemented, injected or cast into position and are elastically deformable, so that no snow or ice can pack into the space. The distance pieces 8,9 are preferably snow- and water-repellant and/or produced from a material that absorbs no moisture. It is preferred that they be porous and have an impermeable outer skin and/or consist of cellular foamed plastic.

The toe unit 10 is attached to the centre section 5 opposite to and raised above the surface 11 of the side sections 6,7; the spaces 13,14 that this arrangement leaves between the underside 12 of the toe unit 10 and the surface 11 can also be filled with distance pieces 15,16 that preferably possess the same properties as the distance pieces 8,9.

The raised arrangement can be augmented by a hard layer between the toe unit 10 and the centre section 5, or by a section of the toe unit so that the non-skid section and/or the coating is pressed beyond the sliding surface of the ski into the snow during each push-off phase, thereby forming a particularly effective frictional connection between the sole of the ski and the snow. To this end, the immediate or mediate surface of the centre section 5 must thus always be higher than that of the side sections 6,7, by approximately 1 to 5 mm, for example. At the same time, the sole 17 of the centre section 15 is a little above the remaining sole of the ski, for example 1 to 1.5 mm, during the glide phase. The centre section 5 can be thicker than the thickness of the side sections 6,7. In the exemplary version shown in FIGS. 1 and 2, however, the centre section 5 is arched upwards, thereby forming a more effective sprung portion. In this case the toe unit 10 can be attached directly on the centre section 5, as is shown in FIG. 2.

The centre section 5 is tensioned or held by its own natural springiness, and additionally by the distance pieces 8,9,15,16 such that the running surface 17 is only pushed down when the whole weight of the body and additionally the push-off force or a component of this acts on the centre section 5. This total force is felt regularly in the push-off phase, primarily in the onset area of this, and is independent of the shoe position. Normally, the push-off force or components is/are produced by the ball of the foot or the ball part of the shoe sole, thus when the heel 18 is raised to a minimum extent. In this sector of the effect, the distance pieces 8,9,15,16 are correspondingly deformed.

In the glide phase, i.e., when the skier is standing on the balls of his feet and his heels, approximately half of the skiers body weight is acting on the centre section 5. In this state, the centre section 5 and the surface 17 lifts away from the snow because of the sprung arrangement of the centre section 5, and the skis run exclusively on the smooth running surfaces or soles.

In order to guarantee the raised arrangement of the centre section 5 during the gliding phase if, for instance, hard shocks occur, for example, as a result of short undulations in the terrain, and as a result the straightening force is either reached or exceeded, a lever arm 22 is provided; this is configured as a rocker, extends towards the rear, and is supported so as to be able to pivot about a pin 21 on the side sections 6,7. This lever arm extends to a position below the heel 18. Preferably, within the heel 18 there is a slot 23 that serves to centre the arm 22. When pressure is exerted on the lever arm 22 through the heel 18 the centre section 5 is held in the raised position. When this happens, the heel rests securely on both sides of the lever arm that extends rearwards, on the side sections 6,7 of the ski. Any possible lowering of the centre section 5 is hindered when the lever arm is in the position described above, although the heel has only to move a few millimeters from the lever arm 22, and this will be sufficient to press the centre section 5 into the push-off position when the weight is shifted to the balls of the feet. In order to ensure permanently trouble-free operation in this case, too, an elastic, solid distance piece 24 is fitted between the lever arm 22 and the ski 1, or between the centre section 5, the pivot pin 21, and the ski 1. In place of a distance piece 24 it is also possible to shape the lever arm 22 on its under surface 22' and optionally on its upper surface so as to render it snow-repellant and so that it will break up solid snow and ice. It is expedient that it be pointed or elliptical.

In the exemplary version of the present invention that is shown in FIG. 3, the centre section 5' is connected to the ski at its front end 25, either through an elastic, solid distance piece 26 that serves as a pivot point, or directly in one piece, for example by cutting out the centre section 5' from the ski 1. The rear intermediate space 27 is closed off by an elastic, solid distance piece 28. The latter also serves to ensure that when there is suitable pressure exerted on the centre section 5' by the ball of the foot area of the shoe, the centre section 5' is pivotted downwards, above all about the front attachment (as indicated by the arrow 29). Here, too, there can be a lever arm 22. In place of the elastic distance piece 28, or in addition to this, e.g., integrated in this, there can also be a mechanical spring element such as a coil spring, a spring disc, or a similar spring element. Versions of this kind are described below on the basis of FIGS. 6 to 9. With a suitable configuration, and while retaining the advantages set out above, it is also possible to provide the pivot point at the rear end 25.

It is preferred that the centre section 5' extend from the front to a rear end piece obliquely upwards, with the end piece 30 being in part preferably above the surface 31 of the ski (1).

When a lever arm 22 is used, this is preferably supported between the heel or the heel piece 18 and the ball of the foot on the side sections 6,7 and attached securely to the centre section 5 or 5' between the support point 21 and the toe unit 10. The support point 21 is thus located between the heel 18 and the attachment point 32 of the lever arm 22 on the centre section 5,5'. Basically, it is also possible to arrange the lever such that the support point 21 is located behind the heel, as in FIG. 2. For the case that the centre section 5 or 5' is either connected to the remainder of the ski 1 at one, preferably the front, end, or that the centre section 5 or 5' is installed as an individually produced part or as a section cut from the ski 1 and installed subsequently, the pretensioning of the centre section 5 or 5' can be deliberately adjusted and/or increased or reduced by additional spring elements 26,28. Versions of this kind, with a distance piece in the form of a mechanical spring device 33, for example, a coil spring, are shown in FIGS. 6 to 9.

In FIGS. 6 and 7 there is a spring clamp 34 attached to the rear of the centre section 5'. Between its upper, approximately horizontal, upper arm 35 and the surface of the ski 31 there is a coil spring 33. It is advantageous that this can be replaced by a coil spring having lower or higher spring constants. In addition to this, the tension of this coil spring 33 can be adjusted in that the upper end 36 is supported in an upper adjusting plate 37, the level of which can be adjusted by the threaded shaft 38 of an adjuster in the form of an adjuster screw 39. The adjuster screw 39 can be screwed into the arm 35 and press the end of the screw shaft against the adjuster plate 37, these parts being connected to each other so as to be able to rotate but being axially immobile. However, it can be expedient to arrange the adjuster screw 39 in the arm 35 so as to be able to rotate but axially fixed, and the adjusted plate 37 such that it can be screwed onto the threaded shaft 38. This entails the advantage that the screw head either does not protrude beyond the arm 35, or protrudes only a little.

Appropriate selection of the tension of the spring 33 can match the desired effect to the weight, ability and push-off strength of the individual skier relatively accurately. Thus, the tension can be so adjusted that only when the centre section 5 or 5' is heavily loaded by the ball of the foot to a weight that corresponds to the total body weight is the centre section 5 or 5' pushed into the effective position.

In an exemplary version that is illustrated in FIGS. 8 and 9, a spring element consisting of two coil springs 33 is arranged ahead of the toe of the shoe. The clamp plate 34 is formed from a simple plate that is secured to the centre section 5 or 5'.

The spring element 33 can also be arranged at a suitable place between the heel 18 and the toe of the shoe 40. In this case, the arrangement is covered by the shoe during movement, and is thus better protected. Preferably, the shoe can also have a cut-out or recess if the clamp 34 protrudes very much above the centre section 5 or 5'.

According to an advantageous development of the invention, the spring element 33 and optionally the open space created by the clamp 34 can be protected by an elastic covering, or else this open space can be filled completely with a material that corresponds to the material used for the distance pieces 8,9,15,16,24,26,28.

According to an advantageous producton process the centre section 5 or 5' is formed during the production process for the ski, so that a spring centre section 5 or 5' that is attached to the body of the ski at both ends, or only at the front end 25, or only at the rear end **25*a*** is obtained, optionally immediately with the desired upwards curvature, or arranged so as to be inclined upward and to the rear or forward and upward. The distance pieces are then attached subsequently, in an appropriate manner.

I claim:

1. A cross-country ski with a body having a movable centre section installed in a centre part of the ski between laterally adjoining side sections, said movable section being provided with a running surface for providing a frictional connection between the ski body and a surface of snow, being movable outwardly relative to a sliding surface of the ski body, being retractable into the ski body into a retracted position wherein its running surface is above the sliding surface; wherein:

(a) the movable centre section of the ski body is configured in a manner causing it to function as a resiliently deflectable spring part that is connected to the remainder of the ski body at at least one end and is held angled upwardly from said one end by foot-responsive means for raising the movable centre section in relation to a top surface of the remainder of the ski body in a glide position wherein the skier's weight is on the heel and ball of the foot;

(b) a ski binding for securing a shoe tip to the ski body is connected to the movable centre section and is arranged in an elevated position relative to the top surface of said adjoining side portions of the remainder of the ski body by said movable centre section, at least when the movable centre section is retracted; and (c) the configuring and relative positioning of the movable centre section and ski binding are operable in conjunction with said foot-responsive means for enabling a skier wearing a shoe attached to said binding to produce said outward movement of the movable section through resilient deflection thereof, from said retracted position, by shifting the skier's weight from the heel and ball of the foot in said glide position onto only the ball of the foot in a push-off position.

2. A cross-country ski according to claim 1, wherein a downwardly depressable lever arm is provided, said lever arm being attached to the movable centre section at a fastening point between the heel and ball of the foot and extending rearwardly from said fastening point below the heel, so as to be depressable thereby, and wherein support means for providing a pivoting support for said lever arm is supported on said adjoining side sections at a location between said fastening point and the heel of the foot.

3. A cross-country ski according to claim 2, wherein at least an upwardly extending surface of said lever arm is positioned for engaging a groove in the bottom of said shoe.

4. A cross-country ski according to claim 1, wherein the movable centre section, when retracted, projects approximately 1–5 mm above the top surface of the ski body.

5. A cross-country ski according to claim 1, wherein the movable centre section is at least as thick as said laterally adjoining side sections.

6. A cross-country ski according to claim 1, wherein the running surface of the movable centre section is 1–5 mm higher than the sliding surface of the remainder of the ski body when the movable centre section is retracted in said glide position.

7. A cross-country ski according to claim 1, wherein at least the running surface of the movable centre section is upwardly curved.

8. A cross-country ski according to claim 1, wherein the movable centre section is joined to the body of the ski by a spring loaded connection having at least one spring element, the spring characteristic of which is changeable.

9. A cross-country ski according to claim 8, wherein said spring element is replaceable by another spring element having a different spring constant for changing the spring characteristic.

10. A cross-country ski according to claim 8, wherein adjustment means is provided for changing the spring characteristic by changing the degree of initial compress of said spring.

11. A cross-country ski according to claim 8, wherein the spring element is disposed forwardly of a position at which the toe of a shoe is held, in use, by said binding.

12. A cross-country ski according to claim 8, wherein the spring element is disposed rearwardly of a position at which the heel of a shoe is held, in use, by said binding.

13. A cross-country ski according to claim 8, wherein said foot-responsive means comprises a safety element, formed of a lever mechanism that is mounted on said side portions and has a lever arm positioned for operation by the heel of a shoe held, in use, by said binding and another lever arm which is connected to the movable centre section, said safety element serving as a means for securing said movable centre section against unintended downward movement when the heel of said shoe is planted on the ski in said glide position.

14. A cross-country ski according to claim 4, wherein the spring element is a mechanical spring fixed between a clamp attached at the centre section and the ski body, and wherein the compression of said spring is changeable by adjustment means.

15. A cross-country ski according to claim 14, wherein the adjustment means comprises an adjustment screw rotatably supported by said clamp and an adjustment plate that is axially displaceable with the adjustment screw and which presses against an end of the spring element.

16. A cross-country ski according to claim 15, wherein the spring element comprises at least one helical spring.

17. A cross-country ski according to claim 15, wherein said spring element is replaceable by another spring element having a different spring constant for changing the spring characteristic.

18. A cross-country ski according to claim 1, further comprising a safety element, formed of a lever mechanism that is mounted on said side portions and has a lever arm positioned for operation by the heel of a shoe held, in use, by said binding and another lever arm which is connected to the movable centre section, said safety element serving as a means for securing said movable centre section against unintended downward movement when the heel of said shoe is planted on the ski in said glide position.

19. A cross-country ski according to claim 8, wherein a space between said side portions and the elevated binding is sealed off with an elastic, snow-repellant seal element that is formed of a material which will resist absorption of moisture.

20. A cross-country ski according to claim 1, wherein a space between said side portions and the elevated binding is sealed off with an elastic, snow-repellant seal element that is formed of a material which will resist absorption of moisture.

21. A cross-country ski according to claim 1, wherein the movable centre section is joined to the remainder of the ski body at a front end via a solid, elastic connecting element.

22. A cross-country ski according to claim 20, wherein longitudinal slots between the movable centre section and the side portions are filled by elastic, snow-repellant distance pieces that will resist absorption of moisture.

23. A cross-country ski according to claim 22, wherein at least one of the seal element and the distance pieces is configured to operate as a spring element.

24. A cross-country ski according to claim 19, wherein the movable centre section is joined to the remainder of the ski body at a front end via a solid, elastic connecting element.

25. A cross-country ski according to claim 24, wherein longitudinal slots between the movable centre section and the side portions are filled by elastic, snow-repellant distance pieces that will resist absorption of moisture.

26. A cross-country ski according to claim 7, wherein the spring characteristic of the spring element is set to a level coordinated to the weight of a skier to permit movement of the centre section into the push-off position only by a load that approximates the weight of the skier.

27. A cross-country ski as in claim 1, wherein said side portions have smooth sliding surfaces.

28. A cross-country ski according to claim 1, wherein the movable centre section is joined to the remainder of the ski body portion at both ends.

29. A cross-country ski according to claim 28, wherein said movable centre section is formed of the same structural component as the remainder of the ski body.

30. A cross-country ski according to claim 25, wherein at least one of the seal element and the distance pieces is configured to operate as a spring element.

31. A cross-country ski according to claim 1, wherein the movable centre section is joined to the remainder of the ski body portion at only one end, an opposite end thereof being held by said foot-responsive means in a raised position relative to the remainder of the ski body in said glide position.

32. A cross-country ski according to claim 31, wherein said movable centre section has an inherent spring characteristic which acts to displace said opposite end into said raised position.

33. A cross-country ski according to claim 31, wherein said movable centre section is formed of the same structural component as the remainder of the ski body.

34. A cross-country ski according to claim 1, wherein said movable centre section is installed in a cut-out area of said centre part of the ski.

35. A cross-country ski according to claim 30, wherein the material of which the seal element is formed is a cellular foamed plastic.

* * * * *